US005367291A

United States Patent [19]

Fockens

[11] Patent Number: 5,367,291

[45] Date of Patent: Nov. 22, 1994

[54] SHOPLIFTING DETECTION SYSTEM WITH PARTLY SCREENED ANTENNAS

[75] Inventor: Tallienco W. Fockens, Eibergen, Netherlands

[73] Assignee: N.V. Nederlandsche Apparatenfabriek Nedap, Groenlo, Netherlands

[21] Appl. No.: 952,835

[22] PCT Filed: May 1, 1991

[86] PCT No.: PCT/NL91/00074

§ 371 Date: Nov. 30, 1992

§ 102(e) Date: Nov. 30, 1992

[87] PCT Pub. No.: WO91/17533

PCT Pub. Date: Nov. 14, 1991

[30] Foreign Application Priority Data

May 1, 1990 [NL] Netherlands ..... 9001033

[51] Int. Cl.[5] ..... G08B 13/187

[52] U.S. Cl. ..... 340/572; 340/551

[58] Field of Search ..... 340/572, 551

[56] References Cited

FOREIGN PATENT DOCUMENTS

| | | |
|---|---|---|
| 0059063 | 9/1982 | European Pat. Off. . |
| 0130286 | 1/1985 | European Pat. Off. . |
| 0322720 | 7/1989 | European Pat. Off. . |
| 0352513 | 1/1990 | European Pat. Off. . |
| 731965 | 9/1932 | France . |
| 2553523 | 4/1985 | France . |
| 3616906 | 11/1986 | Germany . |

*Primary Examiner*—Glen Swann

*Attorney, Agent, or Firm*—Jacobson, Price, Holman & Stern

[57] ABSTRACT

An electromagnetic shoplifting detection system of the type operating with a high-frequency detection field, including at least one antenna coil (6, 7) mounted adjacent to or on a checkout unit (K1, K2) for generating an electromagnetic alternating field by which detection labels having a resonant circuit can be detected, the checkout unit containing electrically conducting elements (11) in which elements in operation parasitic currents are produced due to the alternating field, and which conducting elements form a parasitic signal path, and devices (20, 30) arranged between the at least one antenna and the checkout unit for providing an electromagnetic shield between the at least one antenna coil and checkout unit.

15 Claims, 3 Drawing Sheets

SHOPLIFTING DETECTION SYSTEM WITH PARTLY SCREENED ANTENNAS

BACKGROUND OF THE INVENTION

The invention relates to an electromagnetic shoplifting detection system of the high-frequency type. In known shoplifting detection systems, a transmitting coil of a transmitter or a transmitter/receiver generates a magnetic alternating field with a periodically varying frequency. This frequency is generally in the range of 1 to 10 MHz. To the articles to be protected so-called detection labels are attached. These labels each comprise a resonant circuit consisting of an air-core coil tuned with a capacitor. If such a label is carried into the magnetic alternating field of the transmitter coil, at those instants when the frequency of the alternating field is equal to the resonant frequency of the resonant circuit in the detection label, that resonant circuit will absorb energy and then oscillate. This oscillation can be detected by a receiver circuit, which is either connected to the transmitting antenna, as is the case in a so-called absorption system, or is coupled with a second (receiving) antenna, as is the case in a so-called transmission system. Such shoplifting detection systems are known inter alia from applicant's Netherlands patent applications 82.02951 (corresponding to U.S. Pat. No. 4,686,517) and 89.00658. The transmitting/receiving antennas of a complete shoplifting detection system can for instance form a row of upright panels or self-supporting antenna coil constructions, sometimes referred to as pillars. Heretofore, the pillars have mainly been used in clothes stores, with the pillars being positioned directly in front of the exits. In such surrounding, the pillars are mounted directly on the floor, the direct vicinity of each pillar being free of obstacles. A new application of shoplifting detection systems of the high-frequency type concerns their use in supermarkets, where the articles purchased are paid for at so-called checkout units. Checkout units are normally constructed with metal beams, metal or wooden surfaces, provided with a conveyor belt, an (electronic) cash register and sometimes a barcode scanner. A cashier is seated in such a checkout unit, the customers pass in front of the unit and deposit the articles to be paid for on the conveyor belt. The belt carries the articles to the cashier, who enters them in the cash register using a barcode scanner, if provided, and finally payment is effected. The articles have meanwhile passed on to a location on the checkout unit behind the cashier, in the direction of the exit of the supermarket, i.e. a separation occurs of the stream of articles to be paid for and the customers involved. In a typical supermarket situation a series of these checkout units are lined up in a row and the customers pass between the checkout units in the direction of the exit. This system is sometimes referred to by the term "checkout system". To check whether customers who pass the checkout unit take out articles without depositing them on the belt, i.e. without paying for them, the customers must pass a detection field. For that purpose, one or two detection pillars are arranged in the passage which is formed between two checkout units and which the customers pass through.

Since the interspace is small with a view to efficient use of space, the pillars are arranged as close to the checkout units as possible; accordingly, in practice, the pillars are affixed to the checkout units. The detection pillars generate a magnetic alternating field on both sides. Similarly, the detection pillars have a sensitivity area extending on both sides of the pillar. The field on one side covers the passage the customers pass through; the field on the other side extends into the checkout unit. There are many conductors in the checkout unit. In the first place, metal beams, which form the mechanical structure of the checkout unit, can be conductors. In the second place, there may be disposed in the checkout unit many electricity lines, such as lines for the electricity supply to the checkout unit, for the conveyor belt, the cash register, the scanner, etc. In addition there are lines present for data transfer for the cash register, the scanner, the cash register computer system, etc. Thus a checkout unit can contain a whole system of cable ducts with cables, which, in addition, pass from the checkout unit and in many cases continue via the ceiling into other checkout units and which, moreover, provide connections with electrical and electronic apparatus arranged at other locations within the building of the supermarket. It is known from the general theory of the Electromagnetic field that a magnetic alternating field induces voltages, and hence currents, in all conductors disposed in that field. Conversely, conductors that carry an alternating current will generate a magnetic alternating field. In this way, the alternating field of the pillar, which penetrates into the checkout unit, will induce currents in the framework of the checkout unit, and in all cables disposed therein. These currents can travel form one checkout unit to another along the cable connecting the checkout units. There, these currents can induce voltages in the pillars mounted on the checkout units. In an absorption system, in which the transmitting and receiving antenna are shared, these parasitically coupled transmitted signals are superposed on the system's own transmitted signal. In a transmission system, the receiving antenna receives the directly coupled transmitted signal from the corresponding transmitter pillar, onto which the parasitically coupled transmitted signals of the other pillars are superposed. These parasitic signals have traversed signal paths which have a different length from the signal which the pillars are normally excited with. The signal paths in question are long relative to the wave length of the transmitted signal. With the widely used fundamental operating frequency of 8.2 MHz, where the transmission frequency in fact sweeps between 7.5 and 8.9 MHz, the wave length varies between 40 and 33.7 m. Across this distance, apart from a number of effects which make this distance shorter, there occurs a phase rotation of 360° over the signal path. Depending on the phase difference between the transmitted signal proper and the parasitic signal, the two signals will reinforce or oppose each other.

As this phase difference is frequency-dependent, during the frequency sweep a change will occur from addition to subtraction of the signals and vice versa. It is further of importance that the parasitic signal paths consist of just any conductors, which are not intended to transport high-frequency signals and hence exhibit an altogether unpredictable behavior. As a result, impedances of signal sources do not correspond at all with characteristic impedances of the (parasitic) signal paths. Further, these characteristic impedances vary strongly along the course of a signal path. The signal paths are not characteristically terminated at all. The result is that along such a parasitic signal path, there are many points of reflection where the signal is reflected. The cables extending further into the building, too, exhibit points of reflection at greater distances, so that also signals with a great delay are reflected and exert their influence in the receiver. Therefore, in the cables of the checkout units, a multiplicity of standing waves arise, which standing wave pattern varies strongly with the variation of the frequency during the frequency sweep. Thus, the pattern of parasitic signals which a) go from one transmitter to one receiver via different paths, and b) go from different transmitters to one receiver, will exhibit a very erratic and unpredictable amplitude and phase behavior. In the radio communication technique this phenomenon is known by the name of multipath propagation. In the radio communication technique, it is also known that multipath propagation can give rise to serious signal distortion, particularly with frequency-modulated signals. In shops, multipath propagation can also be caused because the transmission field that extends into the checkout unit also induces currents in the metal framework. Due to its large dimensions, the framework will operate as an effective antenna, which in turn can induce currents in the framework of the adjacent checkout units, so that the pillars mounted thereon or adjacent thereto thereby receive a parasitic signal. These high-frequency currents in the framework are also responsible for the fact that false detection can happen when labels are disposed in certain locations of the checkout unit where an inductive coupling with the frame can occur. Finally, there is yet another coupling mechanism that can cause parasitic currents, which do not result from the magnetic alternating field generated by the pillars, but are caused by capacitive coupling. The parts of the transmitting antenna carry a high-frequency voltage.

On account of the area of the antenna parts a certain capacitance is present relative to the free space. As a result, a high-frequency current will flow to the free space (dielectric displacement flow). When an electric conductor of sufficient size is disposed in the vicinity of an antenna part, as a result of the capacitance from antenna part to conductor, an additional capacitive current will flow to this conductor. This current will continue into that conductor. When the conductor is connected to the above-mentioned cables in the checkout unit, this current will contribute to the parasitic couplings and hence to the multipath propagation effect. As the voltages on the antenna are symmetrically distributed, the capacitive currents will compensate each other due to the capacitances to the free space of the separate parts of the antenna. However, if the surroundings of the pillar are asymmetrical as far as the presence of electric conductors is concerned, the currents of the different parts will no longer compensate each other and a part of the total current will be compensated by a current coming from the feeder cables. These are common mode currents, which, because coaxial cables are involved here, are referred to as sheath currents here. The fact is that these high-frequency currents travel over the outside of the coaxial sheath. In reciprocal direction it is possible that these sheath currents induce signal voltages in receiving antennas which are also arranged in electrically asymmetrical surroundings, and thus contribute to the parasitic couplings. A solution for the effects of sheath currents has previously been described in applicant's Netherlands patent application 90.00377, which has been withdrawn prior to publication thereof.

BRIEF SUMMARY OF THE INVENTION

The objection of the present invention is to provide a solution to the problems outlined hereinabove, caused by parasitic couplings.

To that effect, according to the invention, in an electromagnetic shoplifting detection system of the type operating with a high-frequency detection field and comprising at least one antenna coil mounted adjacent to or in a checkout unit for generating an electromagnetic alternating field by means of which detection labels comprising a resonant circuit can be detected, the checkout unit containing electrically conducting elements, in which conducting elements in operation parasitic currents are produced owing to the alternating field, and which conducting elements form a parasitic signal path, means are arranged between the at least one antenna coil and the checkout unit for providing an electromagnetic shield between the at least one antenna coil and the checkout unit.

The invention is based on the insight that in view of the great complexity of the parasitic signal paths, the only appropriate solution is to block the part of the signal path which all separate paths have in common, namely the magnetic and capacitive connection between each pillar and the checkout unit which the pillar is mounted to or in or is arranged adjacent to. That implies that a shield is to be arranged, in such a way that neither the magnetic nor the electric field extends into the checkout unit any longer.

BRIEF DESCRIPTION OF THE DRAWINGS

The invention will now be further described, by way of example, with reference to the accompanying drawings, wherein.

DETAILED DESCRIPTION

Figure 1:
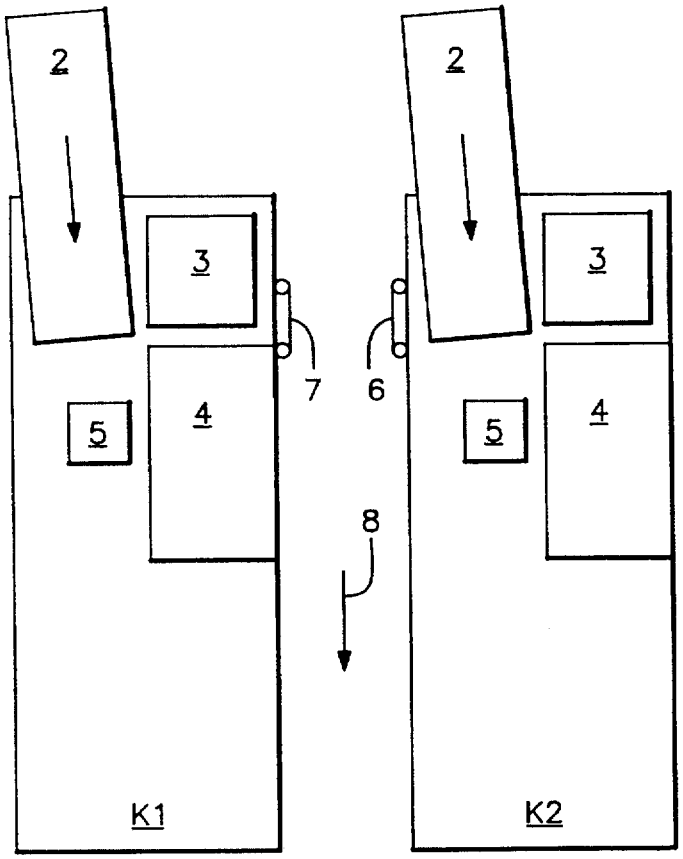
FIG. 1 is a schematic top plan view of two checkout units arranged side by side, comprising antennas of a shoplifting detection system.
Figure 2:
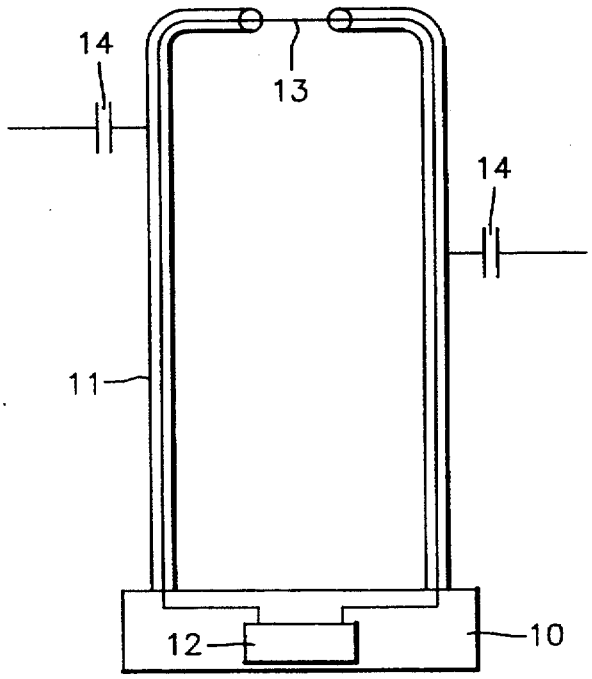
FIG. 2 is a schematic elevational view of an embodiment of a detection pillar.

FIG. 1 schematically shows a top plan view of two checkout units K1, K2 arranged side by side, as encountered in supermarkets. Each checkout unit has a conveyor belt 2 for carrying the articles purchased towards the cashier. The cashier has a seat 4 which is disposed adjacent a cash register 3 and a barcode scanner 5. The passage for the customers is indicated at 8. In the example shown, there is indicated at 6 and 7 an antenna coil of a high-frequency shoplifting detection system, which is for instance shaped as a pillar as shown in FIG. 2. The antenna 6 may for instance be a receiving antenna and the antenna 7 a transmitting antenna.

The field of a transmitting antenna arranged in this manner does not only extend into the passage 8 but also into the checkout unit which the antenna is mounted in or secured to. If the checkout unit comprises electrically conducting parts, for instance construction parts, or electricity lines, there are formed the above described parasitic signal paths and parasitic signals which interfere with a proper operation of the detection system.

FIG. 2 shows an example of an antenna pillar for use in electromagnetic shoplifting detection systems. The pillar has a base 10 having mounted thereon a pipe 11 in which is disposed the actual loop-shaped antenna wire 13 of the antenna coil. The base further comprises the electronic unit 12 of the antenna, which unit provides the signals for the antenna and/or processes and passes on the signals from the antenna. The capacitance between the antenna pipe and the surroundings is schematically indicated at 14.

Figure 3:
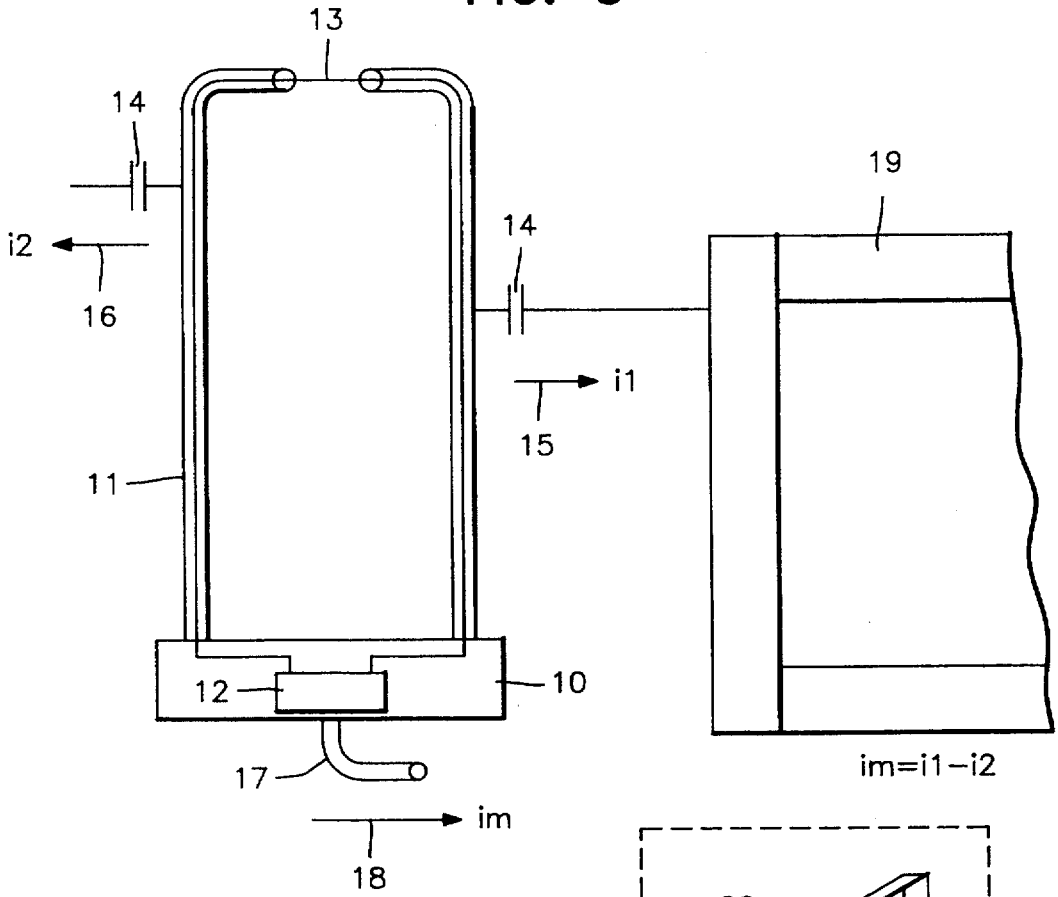
FIG. 3 is a schematic elevational view similar to FIG. 2 which illustrates the capacitive coupling between a detection pillar and the surroundings.

FIG. 3 shows a similar antenna adjacent a metal frame part 19 of a checkout unit, for instance. The capacitive current $i_1$ to the conducting part 19 is schematically indicated at 15 and the capacitive current $i_2$ to the free space at 16. Further, in a coaxial feeder cable 17 of the electronic unit 12, sheath currents $i_m$, which represent the difference between $i_1$ and $i_2$, can arise in the manner described above.

Figure 4:
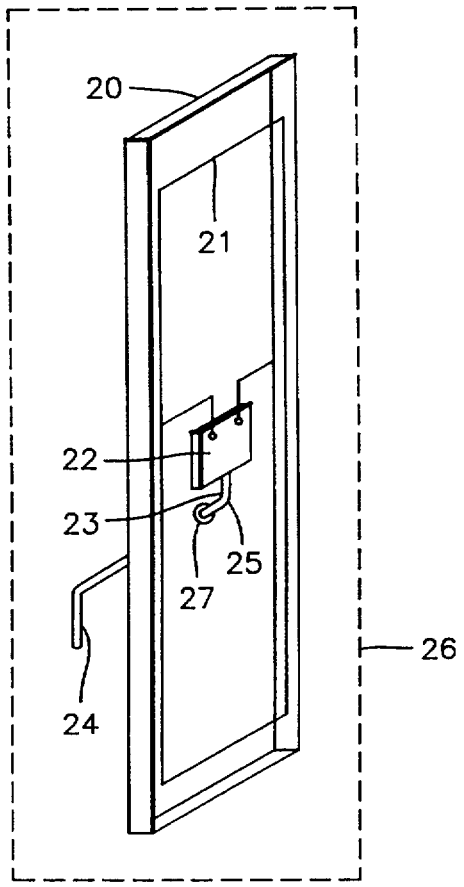
FIG. 4 is a schematic perspective view which shows an embodiment of shielding means according to the invention.

FIG. 4 schematically shows an antenna provided with an embodiment of a shield according to the invention.

According to the invention, the shield can be a metal plate whose most important property is a good electric conductance. The plate has a width well in excess of the width of the antenna 21 and a height well in excess of the height of the antenna. Preferably, the edges are flanged, so that a box 20 is formed, having one side still open. Then a magnetic alternating field can only be generated on the open side of the shield, i.e. in the area where the customers pass. To achieve adequate shielding by the metal plate, whether or not box-shaped, requirements as to thickness must be set. The magnetic alternating field penetrates into the metal to a certain depth, the so-called penetration depth. For adequate shielding, the plate must be so thick that on the other side of the plate the magnetic alternating field is weakened by at least 40 dB. With reference to conducting materials, the term "skin depth" is known: the depth at which the field has decreased by a factor e (2.7). This means that the formula $d = \ln 100 = 4.6 \times$ skin depth applies to the minimal plate thickness. The skin depth is determined by the material properties of specific resistance and relative permeabilities, and by the frequency of the alternating field. For a material such as aluminum and a frequency of 8 MHz, a skin depth of 31 μm applies. The plate must therefore be at least $4.6 \times 31$ μm $= 0.14$ mm thick. In constructional terms, this means that solutions consisting of metal layers deposited on glass plate by evaporation or similar carriers are insufficient. Accordingly, sheet material of a substantial thickness must be used.

Figure 5:
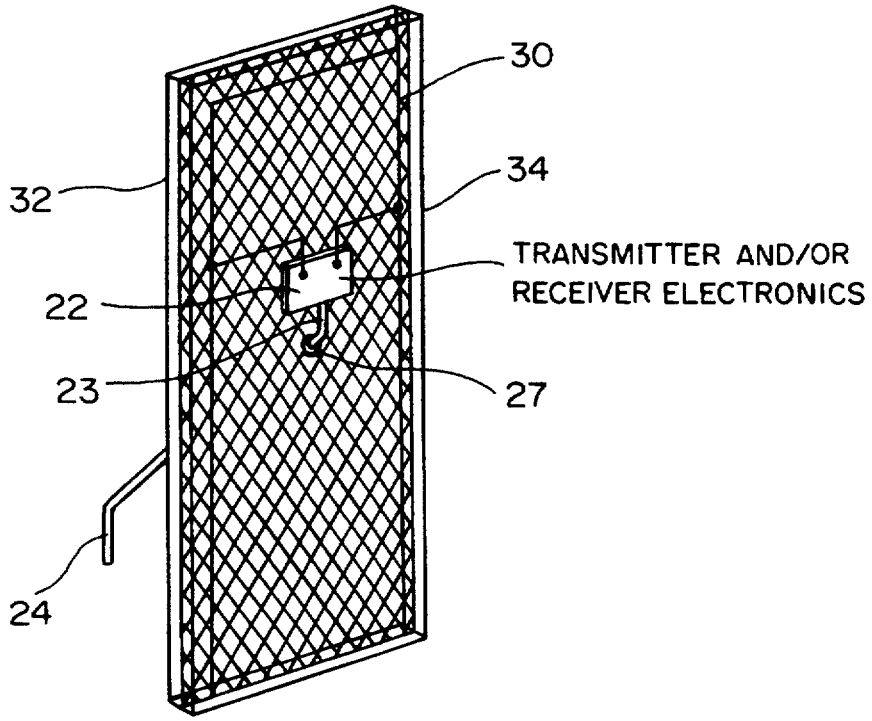
FIG. 5 is a view similar to FIG. 4 showing the embodiment utilizing mesh as a transparent shielding material.
Figure 6:
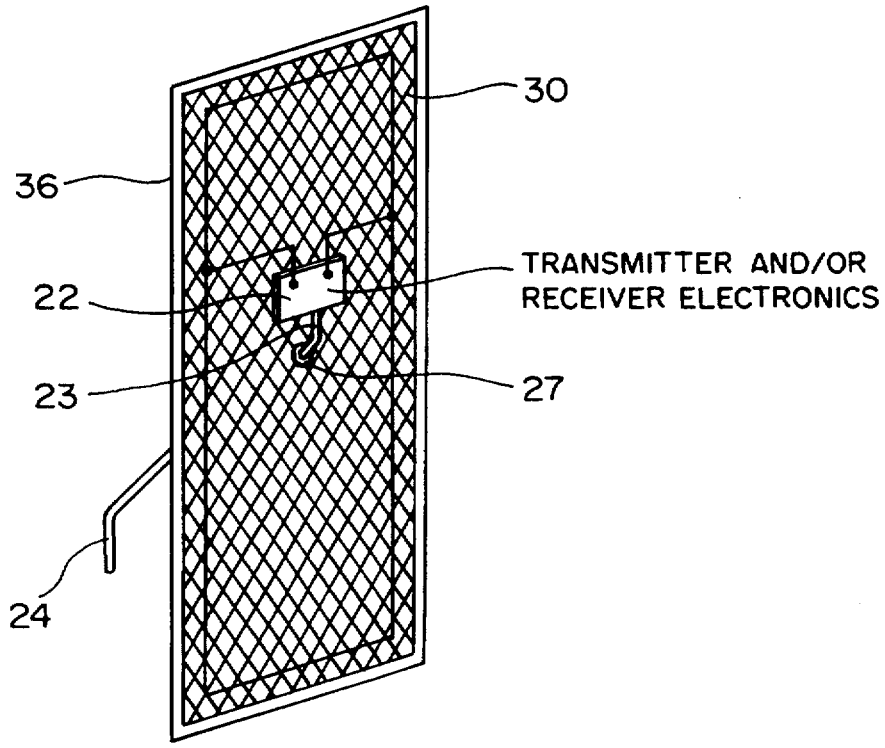
FIG. 6 is a view similar to FIG. 5 showing mesh used in a planar shielding element.

A practical problem is that the shield has dimensions exceeding the dimensions of the original antenna, for instance a height of 1.6 m and a width of 40 cm. The pillar is arranged beside the checkout unit, beside the cashier's seat. The customer passes on the other side of the pillar, so that the cashier loses sight of the customer. This is an undesirable situation so that a shielding material that is transparent and yet has a substantial thickness is preferable. A solution is found in the use of mesh such as shown at 30 in FIGS. 5 and 6. Mesh consists of a fabric of metal wires. It is essential that the separate metal wires make good electrical contact at each intersection. This, together with the wire density, determines the specific resistance of the mesh, seen as a metal sheet. The wire thickness determines the thickness of the mesh as a shielding plate, so that the skin depth and the shielding capacity can be calculated in a manner analogous to that in the case of a solid plate of metal. It is of importance that the mesh, which does not by nature possess a mechanical strength of its own, is mounted in such a way that it behaves as a stable plate. This can be realized for instance by clamping the mesh 30 between two transparent plastics plates or casting it in glass or plastics as shown at 32 and 34 in FIG. 5. Another solution might be to fix the mesh to a metal frame, for instance a circumferential aluminum section 36 as shown in FIG. 6. This framework can further be used for attachment to the floor or to the checkout unit. Other constructional solutions are conceivable and considered to fall within the scope of the invention. As the distance between two checkout units is very limited with a view to efficient use of the floor area and in actual fact is determined by the width of a shopping trolley, it is of importance that the overall thickness of the antenna with the shield be a small as possible. However, a short distance between antenna and shielding plate implies that damping becomes high and that turning the antenna becomes strongly dependent on this distance. Due to this dependence, the risk of microphonic effects increases and the capacitive current from antenna to shielding plate becomes large, which causes a reduction of the effectiveness of the antenna as a magnetic antenna. A distance of 4 cm between antenna and shield has been found to be a good compromise, so that the total thickness of antenna plus shield need not be greater than 5 cm.

With this distance between antenna 21 and shield 20, however, there still flows a non-negligeable capacitive current between the separate parts of the antenna and the shield. It has already been noted above that the voltages on the different parts of the antenna are symmetrical, so that the voltage integrated over the entire antenna relative to the shield is zero. If the shield is also arranged symmetrically relative to the antenna, the currents will also compensate each other. In practice, however, this compensation will never be complete. The middle of the antenna, which is also the connecting point of the antenna and the transmitter and/or receiver electronics 22, will then carry a high-frequency voltage relative to the shield. In that case, this voltage will also be on the connecting point of the (coaxial) cables 24, 25, which connect the electronics unit with the other pillars, and can thus cause the sheath currents referred to earlier. This problem can be solved by passing cables through an aperture 27 in the shield, in such a way that for the high-frequency currents a connection is made to the inner side of the shield. This means that the sheath 23 of coaxial cables must be grounded roundabout to the shield at the point where the cable passes through the shield. FIG. 4 shows the portion of a cable disposed on the inside of the shield at 25 and a portion disposed outside of the shield at 24. It is strictly required that of other signal cables, every core be short-circuited with the shield at the point where it passes through the shield, with an uncoupling capacitor for high-frequency currents, for instance with a so-called feed-through capacitor. Alternatively, the signal cables can be provided with a shielding outer conductor 23, this shielding outer conductor having to be grounded roundabout to the shield again, in coaxial manner. On the inner side the shielding outer conductors must be connected to the grounded surface on the electronics print.

Advantageously, the assembly of antenna coil, shield and electronic unit can be constructed into one integrated whole, as schematically indicated at 26 in FIG. 4.

I claim:

1. An electromagnetic shoplifting detection system operating with a high-frequency detection field at least within the range of 1 to 10 MHz mounted adjacent to or on at least one checkout unit for detecting labels having an integrated resonant circuit, said at least one checkout unit having electrically conducting elements providing at least one parasitic signal path producing parasitic currents in use, said detection system comprising:

at least one antenna coil mounted adjacent to or on said at least one checkout unit for generating an alternating electromagnetic field for detecting said detecting labels positioned in proximity to said at least one antenna coil; and shield means comprising electrically conducting mesh disposed between said at least one antenna coil and said at least one adjacent checkout unit for providing an electromagnetic shield between said at least one antenna coil and said at least one checkout unit and preventing parasitic signal paths and parasitic currents in said electrically conducting elements.

2. The electromagnetic shoplifting detection system as claimed in claim 1 wherein:

said shield means further comprises a frame member; and said mesh is clamped in said frame member.

3. The shoplifting detection system as claimed in claim 2 wherein:

said shield means further comprises at least one transparent plate; and said mesh has at least one side thereof disposed against said transparent plate.

4. The detection system as claimed in claim 3 and further comprising:

detection pillar means; and electronic unit means operatively connected to said at least one antenna coil and integrated with said antenna coil into said detection pillar means.

5. The detection system as claimed in claim 2 and further comprising:

detection pillar means; and electronic unit means operatively connected to said at least one antenna coil and integrated with said antenna coil into said detection pillar means.

6. The shoplifting detection system as claimed in claim 1 wherein:

said shield means further comprises at least one transparent plate; and said mesh has at least one side thereof disposed against said transparent plate.

7. The detection system as claimed in claim 6 and further comprising:

detection pillar means; and electronic unit means operatively connected to said at least one antenna coil and integrated with said antenna coil into said detection pillar means.

8. The detection system as claimed in claim 1 wherein:

said shield means comprises a box-shaped member having one open side facing away from said at least one checkout unit; and said at least one antenna coil is mounted within said box-shaped member so that said box-shaped member shields said at least one antenna coil on five sides.

9. The detection system as claimed in claim 8 and further comprising:

detection pillar means; and electronic unit means operatively connected to said at least one antenna coil and integrated with said antenna coil into said detection pillar means.

10. The detection system as claimed in claim 1 and further comprising:

detection pillar means; and electronic unit means operatively connected to said at least one antenna coil and integrated with said antenna coil into said detection pillar means.

11. The detection system as claimed in claim 1 and further comprising:

electronic unit means operatively connected to said at least one antenna coil;

an aperture in said shield means; and connecting cables operatively connected to said electronic unit means and passing through said aperture in electrically connected engagement with said shield means at said aperture.

12. An electromagnetic shoplifting detection system operating with a high-frequency detection field at least within the range of 1 to 10 MHz mounted adjacent to or on at least one checkout unit for detecting labels having an integrated resonant circuit, said at least one checkout unit having electrically conducting elements providing at least one parasitic signal path producing parasitic currents in use, said detection system comprising:

at least one antenna coil mounted adjacent to or on said at least one checkout unit for generating an alternating electromagnetic field for detecting said detecting labels positioned in proximity to said at least one antenna coil;

electromagnetic shield means between said at least one antenna coil and said at least one checkout unit;

electronic unit means operatively connected to said at least one antenna coil;

an aperture in said shield means;

connecting cables operatively connected to said electronic unit means and passing through said aperture; and shielding outer conductor means for said connecting cables electrically connected all around in a coaxial manner to said shield means at said aperture.

13. The detection system as claimed in claim 12 wherein:

said shielding outer conductor means are connected to said shield means on the side thereof facing said at least one antenna coil.

14. The detection system as claimed in claim 13 wherein:

said shield means comprises electrically conducting mesh.

15. The detection system as claimed in claim 12 wherein:

said shield means comprises electrically conducting mesh.

* * * * *